US007119131B2

(12) United States Patent
Marth et al.

(10) Patent No.: US 7,119,131 B2
(45) Date of Patent: Oct. 10, 2006

(54) URETHANE BINDER COMPOSITIONS FOR FOUNDRY APPLICATIONS

(75) Inventors: Charles F. Marth, Waynesville, NC (US); George David Green, Cary, IL (US); Raymond J. Swedo, Mount Prospect, IL (US)

(73) Assignee: Dow Global Technologies, Inc., Midland, MI (US)

( * ) Notice: Subject to any disclaimer, the term of this patent is extended or adjusted under 35 U.S.C. 154(b) by 450 days.

(21) Appl. No.: 10/423,612

(22) Filed: Apr. 25, 2003

(65) Prior Publication Data

US 2004/0214917 A1 Oct. 28, 2004

(51) Int. Cl.
*B22C 1/22* (2006.01)

(52) U.S. Cl. ..... 523/142; 524/143; 524/145; 560/26; 560/330

(58) Field of Classification Search ..... 523/142–143, 523/145; 560/26, 330
See application file for complete search history.

(56) References Cited

U.S. PATENT DOCUMENTS 2,760,951 A * 8/1956 Park et al. ..... 528/162
2,856,381 A 10/1958 McNaughtan et al.
3,409,579 A 11/1968 Robins et al. ..... 260/30.4
3,676,392 A 7/1972 Robins ..... 260/38
4,148,777 A 4/1979 LaBar et al. ..... 260/37
4,311,631 A 1/1982 Myers et al. ..... 260/38
4,387,173 A 6/1983 Henry, Jr. et al.
5,281,644 A 1/1994 Iyer et al.

FOREIGN PATENT DOCUMENTS

EP 0 448 237 A2 2/1991

OTHER PUBLICATIONS

Tr. Kazan. Khim.-Tekhnol. Inst., 40(2), 155-171, 1969.
Zh. Prikl. Khim., 45, 1573-1577, 1972.
Vysokomol. Soedin., Ser. A, 13(5), 987-993 1971.

* cited by examiner

*Primary Examiner*—Peter Szekely

(57) ABSTRACT

Foundry cores and molds for casting metals are prepared by forming a binder comprising a polyol, an isocyanato urethane polymer and a urethane catalyst. The binder additives and resin formulations of the invention are especially useful for casting non-ferrous metals, for example, the casting of aluminum, magnesium and other lightweight metals. The cores and molds produced for casting aluminum and other lightweight metals exhibit excellent shakeout while retaining other desirable core and mold properties.

39 Claims, 5 Drawing Sheets

URETHANE BINDER COMPOSITIONS FOR FOUNDRY APPLICATIONS

BACKGROUND OF THE INVENTION

1. Field of the Invention

The invention relates broadly to foundry binders based on organic resins and specifically to resinous binder compositions that are formed by the reaction of phenol formaldehyde condensates and polyisocyanates, known in the foundry trade as phenolic urethanes.

2. Description of the Prior Art

Phenolic urethanes are widely described in the prior art and have been in use for several decades as foundry core and binders. Sand binders form molds or cores for casting of metals, especially aluminum and other lightweight metals which are cast at relatively low temperature. For example, phenolic urethanes based on high molecular weight phenolic resins (i.e., an average of at least 3 aromatic rings per molecule) are described in U.S. Pat. Nos. 3,409,579 and 3,676,392 to Robins. Phenolic urethane foundry binders of a lower molecular weight type are described in U.S. Pat. Nos. 4,148,777 to LaBar et al. and 4,311,631 to Myers et al. While the binders described by these prior patents have, in general, been successful with respect to casting ferrous based metals, which are cast at relatively high temperatures, problems have been observed in using the same binder systems in the casting of aluminum with respect to the breakdown and shake out of the cores after solidification of the metals (also called Thermal Sand Removal, or TSR).

In order to provide a core or mold that is strong enough to maintain its shape and surface during the casting of metals, a fairly high level of binder is required. This is true not only with the phenolic urethane binders but the alkyd-oil binders, the polyester polyol binders, and other types of binders known in the field. However, when sufficient binder is mixed with the sand to form cores and molds having adequate strength to permit handling of the cores or molds and adequate abrasion resistance and hot strength, the resulting cores and molds are difficult to break down and it is difficult to remove the sand from the metal casting, particularly when the casting is made at the relatively low casting temperatures of the light metals, such as aluminum.

Because of the practical importance of this problem to the practices of the foundry art, several approaches have been used in the past to eliminate this problem. On the one hand, organic additives such as sugars have been incorporated into the sand mix. On the other, the quantity of binder has been reduced. Binders with inherently less strength or low heat resistance have also been used. Some have incorporated organic peroxides in the binder in order to aid the oxidative degradation of the said binder at high temperatures; others have included inorganic peroxides in their sand mix. While these efforts have been, by and large, successful in reducing the shake-out problem, there have been highly undesirable aspects associated with them obvious to those familiar wit the art. Therefore, the foundry art has been seeking to find a binder system which will produce cores and molds having adequate strengths and abrasions resistance, but which breaks down well at the casting temperatures of aluminum and magnesium to provide easy shake out.

SUMMARY OF THE INVENTION

According to the invention, foundry cores and molds for casting metals are prepared by forming a binder comprising a polyol, an isocyanato urethane polymer and a urethane catalyst. The binder additives and resin formulations of the invention are especially useful for casting non-ferrous metals, for example, the casting of aluminum, magnesium and other lightweight metals. The cores and molds produced for casting aluminum and other lightweight metals exhibit excellent shakeout while retaining other desirable core and mold properties. The enhanced degradation characteristics attributable to the nitro-additives will thus allow the foundry user to either get equivalent degradation over a shorter time at the standard temperature, or get equivalent degradation at the standard times at a lower temperature. The first instance provides the basis for shortening, or eliminating, the current TSR bake cycle and improving productivity. The second instance provides the basis for reducing energy costs over the current TSR bake cycle. Both scenarios are desirable.

DETAILED DESCRIPTION OF THE PREFERRED EMBODIMENTS

The invention comprises two equally useful embodiments. In the first embodiment, a nitroalcohol is reacted with a standard polyisocyanate to form a nitro-containing isocyanate adduct, which is then used to form the isocyanato urethane polymers described herein. The preferred nitroalcohol of the invention is selected from the group consisting of 2-nitro-2-methyl-1,3-propanediol (NMPD), 2-nitro-2-ethyl-1,3-propanediol (NEPD) and 2-nitro-2-hydroxymethyl-1,3-propanediol (TN). In the second embodiment, a nitronovolac compound, formed by the reaction of a nitroalcohol and a phenol, or alternatively, formed by the reaction of a nitroalkane, phenol and formaldehyde, is used as an additive to the foundry resin binder composition.

Figure 1:
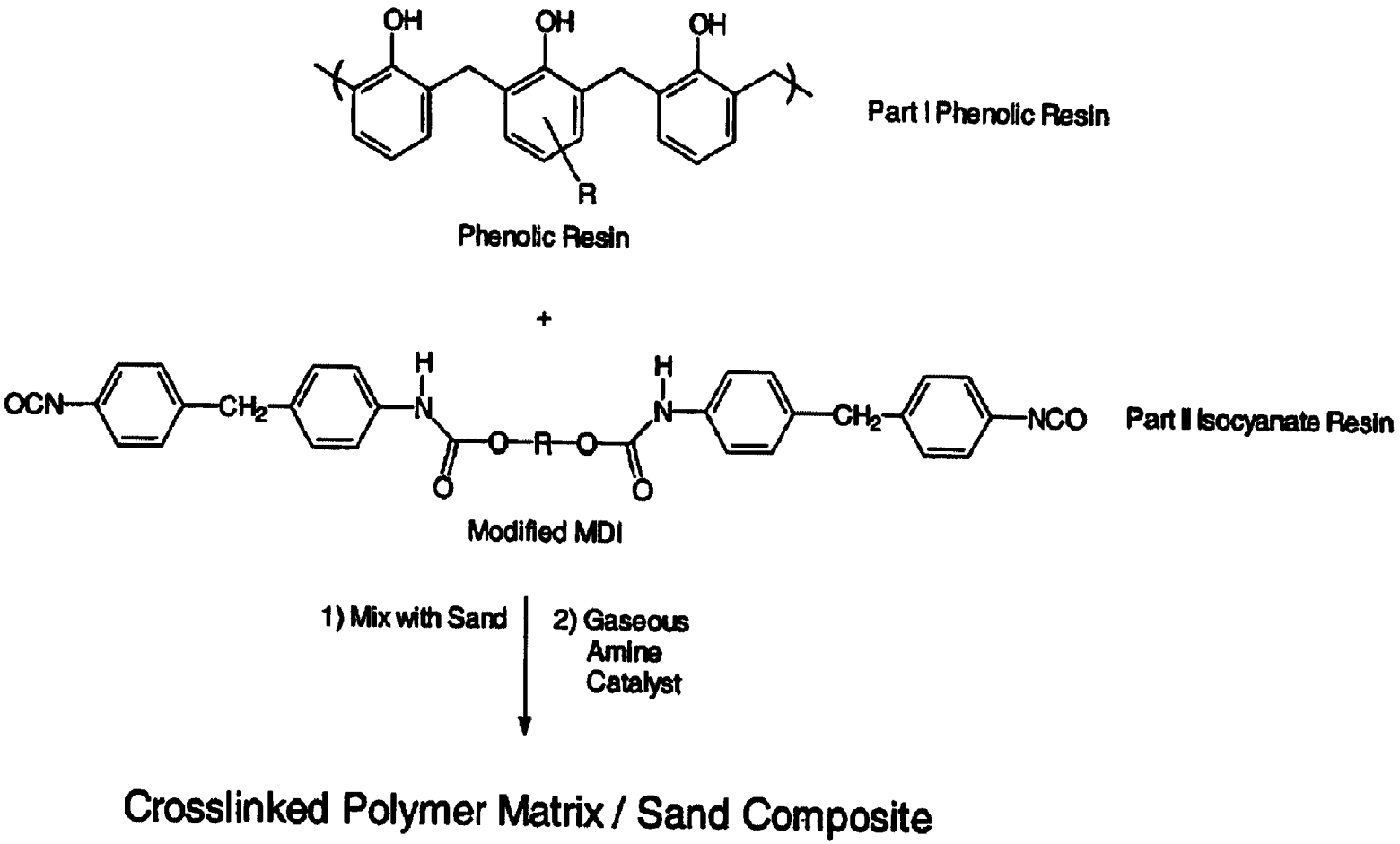
FIG. 1 represents a typical reaction of a phenolic resin with an isocyanate resin, mixing with sand, and catalyzing with a gaseous amine catalyst.

The present invention is particularly useful in connection with phenolic urethane binders that are cured by tertiary amines, commonly known as polyurethane cold box resins (PUCB). The reaction for forming such resins is depicted in FIG. 1.

The present invention is also particularly useful in connection with binders used to produce sand shapes for which foundry castings are created using light-weight metals such as aluminum, which are cast at relatively low temperatures. The molds and cores made with the binders of the present invention demonstrate enhanced thermal degradation, expected to significantly improve shake out, particularly when used with metals at relatively low casting temperatures.

The large majority of aluminum engine blocks and heads being prepared for the North American market utilize PUCB in the foundry application. As such, the discussion and examples contained within this application will concentrate mainly on degradation of PUCB resins. Nonetheless, the concepts demonstrated here for PUCB are equally applicable to other types of foundry resins, including furan resins, phenolic resins, alkyd resins, phosphate polymers and sodium silicates which have been used by the prior art and which suffer from the same shake out problems as described herein for the phenolic urethanes.

The resin compositions of the present invention find particular use as part of a two-part composition or system. Part one is a polyol. Part two is an isocyanato urethane polymer, a specific type of polyisocyanate compound. Both parts are in liquid form and are generally solutions with organic solvents. At the time of use, that is to say, when the urethane binder is formed, the polyol part and the isocyanato urethane polymer part are combined and used for the intended application. In a foundry no bake application, i.e. the use of the compositions as a binder for cores and molds, it is preferred to first admix one part with a foundry aggregate such as sand. Thereafter, the second component is added and after achieving a uniform distribution of binder on the aggregate, the resulting foundry mix is formed or shaped into the desired shape.

Liquid amine catalysts and metallic catalysts known in urethane technology are commonly employed in no bake binder formations. By selection of a proper catalyst, conditions of the core making process, for example work time and strip time, can be adjusted as desired.

Gaseous amine catalysts known in cold box technology may also be employed. The actual curing step can be accomplished by suspending a tertiary amine in an inert gas stream and passing the gas stream containing the tertiary amine, under sufficient pressure to penetrate the molded shape, through the mold until the resin has been cured. The binder compositions of the present invention require exceedingly short curing times to achieve acceptable tensile strengths, an attribute of extreme commercial importance. Optimum curing times are readily established experimentally. Since only catalytic concentrations of the tertiary amine are necessary to cause curing, a very dilute stream is generally sufficient to accomplish the curing. However, excess concentrations of the tertiary amine beyond that necessary to cause curing are not deleterious to the resulting cured product.

Inert gas streams, e.g., air, carbon dioxide or nitrogen, containing from 0.01 to 20% by volume of tertiary amine can be employed. Normally gaseous tertiary amines can be passed through the mold as such or in dilute form. Suitable tertiary amines are gaseous tertiary amines such as trimethylamine. However, normally liquid tertiary amines such as triethylamine are equally suitable in volatile form or if suspended in a gaseous medium and then passed through the mold. Functionally substituted amines such as dimethylethanolamine are included within the scope of tertiary amines and can be employed as curing agents. Functional groups which do not interfere in the action of the tertiary amine are hydroxyl groups, alkoxy groups, amino and alkylamine groups, ketoxy groups, thio groups, and the like.

The isocyanato urethane polymers used to form the urethane binder compositions of this invention are normally produced in a urethane reaction as the reaction product of a polyhydroxy compound and a polyisocyanate. When the term "isocyanato urethane polymer" is use herein it is meant to identify such reaction products but it is not limited specifically to such means of synthesis. Isocyanato urethane polymers are known in the prior art and are at times referred to in the literature as prepolymers or adducts.

Known urethane foundry binders, both of the no bake and of the cold box type, are formed by reacting a polyol and a polyisocyanate. The binder described in this invention is also formed by reacting a polyol with a polyisocyanate. The polyisocyanate component is of a special type which, as previously mentioned, is referred to as an isocyanato urethane polymer. This type of isocyanate is formed by reacting an isocyanate and a polyhydroxy compound to form a urethane compound which contains unreacted isocyanate groups. This reaction "caps" the OH groups of the polyhydroxy compound and leaves free isocyanate groups in the reaction product. These free isocyanate groups are, of course, available for reaction with OH groups present in a polyol.

As has been mentioned above, the most important and unexpected feature of the foundry binder of this invention is its ability to form foundry cores and molds which shake out or readily collapse from lightweight metal castings. The problem of shake out of cores from such castings has long been a problem. It appears that in order for a binder to form cores and molds that provide good collapsibility, the binder must have incorporated therein certain molecular structures which because of their bond strength act as weak links thereby enabling easy breakdown. It is believed that the reason that the isocyanato urethane polymers described in this invention are able to form readily collapsible cores and molds is the presence of certain thermally unstable molecular structures or bonds in the binder. The formation of isocyanato urethane polymers and their use as a component of a foundry binder composition results in the introduction of certain of these thermally unstable groups, for example, $NO_2$ groups, into the binder composition. Polyisocyanates commonly used to form urethane foundry binders, both of the no bake and cold box type, contain groups of higher cohesive energy than the groups which are introduced into the isocyanato urethane polymer described herein.

Among the preferred polyols which are reacted to form the isocyanato urethane polymers described herein are 2-nitro-2-methyl-1,3-propanediol (NMPD), 2-nitro-2-ethyl-1,3-propanediol (NEPD) and 2-nitro-2-hydroxymethyl-1,3-propanediol (TN). The polyisocyanate which is reacted to form the isocyanato urethane polymers described herein must be present in such quantities in relation to the number of hydroxyl groups of the polyol as to enable at least one isocyanate group to remain unreacted while capping all of the OH groups present in the polyhydroxy compound. A wide variety of polyisocyanates could be used. Examples of such polyisocyanates include diphenylmethane diisocyanate (MDI), tolylene diisocyanate (TDI), methylene-bis-(cyclohexylisocyanate) and isophorone diisocyanate (IPDI).

However, it is extremely preferable to use tolylene diisocyanate, referred to hereafter as TDI. TDI owes it preferred status to the fact that the two isocyanate groups of the compound are not equally reactive. Therefore, one of the isocyanate groups is much more prone to react with a hydroxyl group of the polyol than is the other isocyanate group. The selective reactivity of the isocyanate groups of TDI enables the production of an isocyanato urethane polymer of rather well defined structure. As can be appreciated, where the isocyanate groups are not selectively reactive, the resulting isocyanato urethane polymer may have a less definite structure because of the potential for cross-linking, which although capable of use, is not preferred. Isophorone diisocyanate also has the above-described selective reactivity and is a preferred polyisocyanate.

As mentioned above, it is important to select the quantities or mole ratios of the reactants that form the isocyanato urethane polymer so that all OH groups are capped and free isocyanate groups remain when the polymer is formed. Those skilled in the art will recognize the proper mole ratios required in order to cap OH groups and to obtain unreacted isocyanate groups in the isocyanato urethane polymer.

The reaction conditions for producing the isocyanato urethane polymers are known. Preferably, when the polymer is intended for use as a foundry binder, the reaction is carried out in a reaction medium at slightly elevated temperature (40°–45° C.) in the presence of a urethane catalyst. After the polymer is prepared it may be useful to strip the reaction medium using a vacuum to remove solvent and catalysts.

The second component or package of the novel binder composition comprises the isocyanato urethane polymers heretofore described either alone, or in combination with a conventional polyisocyanate. Preferably, the novel isocyanato urethane polymer is mixed with a conventional polyisocyanate. Most preferably, the novel isocyanato urethane polymer is used in a 1:10 to 1:1 ratio with a conventional polyisocyanate. The isocyanato urethane polymer mixture, which can be thought of as the polyisocyanate component, is generally employed in approximately a stoichiometric amount, which is in sufficient concentration to completely react with the polyol component. However, it is possible to deviate from this amount within limits and in some case advantages may result. The isocyanato urethane polymer is employed in the form of an organic solvent solution, the solvent being present in a range of up to 80% by weight of the solution depending upon the isocyanato urethane polymer. In certain cases the reaction medium used in preparing the isocyanato urethane polymer can serve as all or part of the solvent.

Although the solvent employed in combination with either the polyol or the isocyanato urethane polymer of for both components does not enter to any significant degree into the reaction between the isocyanato urethane polymer and the polyol, it can affect the reaction. Thus the difference in the polarity between the isocyanato urethane polymer and the polyol restricts the choice of solvents in which both components are compatible. Such compatibility is necessary to achieve complete reaction and curing of the binder compositions of the present invention. Polar solvents are good solvents for the polyol. It is therefore preferred to employ solvents or combinations of solvents where the solvent(s) for the polyol and for the isocyanato urethane polymer when mixed are compatible. In addition to compatibility the solvents for either the polyol or isocyanato urethane polymer are selected to provide low viscosity, low odor, high boiling point and inertness. Examples of such solvents are benzene, toluene, xylene, ethylbenzene, and mixtures thereof. Preferred aromatic solvents are solvents and mixtures thereof that have a high aromatic content and a boiling point range within a range of 280.degree. to 725. degree. F. The polar solvents should not be extremely polar such as to become incompatible when used in combination with the aromatic solvent. Suitable polar solvents are generally those which have been classified in the art as coupling solvents and include furfural, Cellosolve acetate, glycol diacetate, butyl Cellosolve acetate, isophorone, aliphatic dibasic esters and the like. Some reactive polyols may also be used as a solvent.

Rather than modifying the isocyanato portion of the foundry binder, another aspect of this invention is to use a phenolic polyol containing thermally labile groups, such as $NO_2$. Polymeric phenol/formaldehyde condensates containing $NO_2$ groups, denoted herein as nitronovolacs, are known and have been described by Burmistrov and Chirkunov in the open chemical literature, i. e. Tr. Kazan. Khim.-Tekhnol. Inst., 40(2), 155–171 (1969); Zh. Prikl. Khim., 45, 1573–1577, 1972; and Vysokomol. Soedin., Ser. A, 13(5) 987–993 (1971), the disclosures of which are incorporated herein by reference. Nitronovolacs prepared from the reaction of nitroalcohols with phenol, or from the reaction of nitroalkanes with phenol and formaldehyde are equally useful. It is preferred that the nitroalkane or nitroalcohol used to prepare the nitronovolac is at least difunctional, meaning that more than one phenol/formaldehyde moiety may be bonded to each nitro-bearing carbon. Examples of useful nitroalkanes are nitromethane, nitroethane and 1-nitropropane. Examples of useful nitroalcohols are 2-nitro-2-methyl-1,3-propanediol (NMPD), 2-nitro-2-ethyl-1,3-propanediol (NEPD) and 2-nitro-2-hydroxymethyl-1,3-propanediol (TN). The nitronovolacs thus prepared are dissolved in a solvent as described above. The nitronovolacs may be used either alone, or in combination with a conventional phenolic resin. Preferably, the novel nitronovolac is mixed with a conventional phenolic resin. Most preferably, the novel nitronovolac is used in a 1:10 to 1:1 ratio with a conventional phenolic resin. In the foundry application, the nitronovolac mixtures may be used with conventional polyisocyanates or in conjunction with the nitro-containing isocyanato urethane polymer mixtures described herein.

The binder components are combined and then admixed with sand or a similar foundry aggregate to form the foundry mix or the foundry mix can also be formed by sequentially admixing the components with the aggregate. Methods of distributing the binder on the aggregate particles are well known to those skilled in the art. The foundry mix can, optionally, contain other ingredients such as iron oxide, ground flax fibers, wood cereals, pitch, refractory flours, and the like. The aggregate, e.g. sand, is usually the major constituent and the binder portion constitutes a relatively minor amount. Although the sand employed is preferably dry sand, some moisture can be tolerated.

As previously stated the excellent shakeout or collapsibility of cores made using the binder of this invention is deemed to be a significant and unexpected discovery. The binders of this invention degrade or break down easily to permit separation of the core from the cast metal. For castings at low temperatures, e.g. 1800° F. or below, shakeout has been a major problem. Generally non-ferrous metals including aluminum and magnesium are cast at these temperatures. Failure of the binder to break down causes great difficulty in removal of the sand from the casting. Thus, cores exhibiting a low degree of shakeout or collapsibility, that is to say a low degree of binder degradation, require more time and energy to remove the sand from the casting. The use of the binder compositions of this invention may result, in some instances, of virtually 100% shakeout without the application of any external energy. However, in most commercial applications external energy will be helpful or necessary. The amount of energy, however, will be significantly less than the energy now required to remove cores, bonded with state of the art binders, from lightweight metal castings. The improvement in shakeout is attributable to the presence of the isocyanato urethane polymer in the binder compositions. As will be appreciated by those skilled in the art, the ability of any core to shakeout is dependent to an extent upon the amount of binder used to bond the sand particles into a coherent shape.

The percent binder utilized, based on the weight of the sand, depends upon the desired core properties that are required from the binder system. As can be appreciated, as the amount of binder in the system increases an increase in the tensile strength of the core generally occurs. Accordingly, the binder level may be varied within reasonable limits to achieve the desired performance properties. A preferred range of binder is, in this invention, from 0.7% to 2.6% based upon the weight of sand. However, it may be possible to use as little as 0.5% and as much as 10% binder and still achieve properties which are of advantage in certain applications. However, it has also been noted that when the binder level is increased the degree of shakeout may decrease at the higher binder levels.

The degree of shakeout has also been found to be related to the temperature to which the binder is exposed. It appears that the binder must be exposed to a certain temperature in order for the binder to weaken and for shake out to result. The higher the casting temperature the more likely it is that the shake out will increase. It should be noted that the thickness of the core or mold will be a factor controlling the temperature to which the binder is exposed. For example, with a very thick core the interior of the core may not be exposed to sufficient temperature to allow the binder to break down and to allow shake out to result.

EXAMPLES

Experimental Materials 2,3-dimethyl-2,3-dinitrobutane (DMDNB) is a commercial product available from The Dow Chemical Company.

2-nitro-2-methyl-1,3-propanediol (NMPD) and 2-nitro-2-hydroxymethyl-1,3-propanediol (TN) are commercial products available from the ANGUS Chemical Company.

Sigmacure 7220 Part I Phenolic Resin and Sigmacure 7720 Part II Isocyanate Resin are commercial products available from HA International LLC.

DBE solvent is a mixture of aliphatic diesters available from DuPont.

Ethyl acetate, 1,3-dioxolane, N,N-dimethylacetamide (DMAC), sodium phenylate trihydrate, iron (III) acetylacetonate and tolylene-2,4-diisocyanate (tech grade, 80/20 mixture of 2,4- and 2,6 isomers) were purchased from Aldrich Chemical Company and used as received. Silica sand was obtained either from the Badger Mining Company, Part # F-5574 with a 55 grain fineness, or Fairmount Minerals, part # Wedron 530 with a 55 grain fineness.

LABORATORY CURING STUDIES

The sand mixtures were prepared by vigorously shaking the sand with the calculated amount of Part I (phenolic) resin for 3 minutes in a jar. Part II resin was then added and shaking continued for an additional 3 minutes. The resin coated sand was then poured into a polypropylene tube mold (modified syringe) and compacted using the plunger. The plunger was removed and a gassing assembly comprising flowing $N_2$ with an injection point for adding/vaporizing TEA, was attached to the syringe body. $N_2$ flow was initiated. The injection coupling was opened and a measured amount of triethylamine catalyst was added via microliter syringe. The coupling was closed and the sand "gassed" for 2 minutes. For free standing samples, the cured sand plug was recovered by pushing out of the mold with the plunger.

DOGBONE GENERATION

The sand mixtures were prepared by mixing the sand with the calculated amount of Part I (phenolic) resin for 3 minutes in an overhead mixer. Part II resin was then added and mixing continued for an additional 3 minutes. The resin coated sand was then blown into dogbone samples using a Simpson-Gerosa laboratory gassing unit operating with a 30 psi blow pressure, 1 minute cure time @ 40 C. The catalyst used was Isocure 700 available from Ashland Chemical Company.

TENSILE TESTING

Tensile testing was performed using a Simpson-Gerosa tensile tester. Initial tensile strengths were performed on dogbone samples within 10 minutes of their preparation. Two samples were used and the average value reported. The 24-Hour tensile strengths were measured approximately 24 hours after preparing the dogbone samples. Four samples were used and the average value reported.

THERMAL DEGRADATION TESTING

A CEM MAS-7000 Microwave Muffle Furnace was preheated to 400 C. Two dogbone samples were placed in the oven and a countdown timer activated. The samples were pulled from the oven at the appropriate time and allowed to cool on a steel plate under flowing air. Oven times of 5, 7.5, 10 and 15 minutes were used. After cooling to room temperature, the dogbones were subjected to tensile testing. Two–four samples were used at each time interval and the average tensile value reported.

TGA ANALYSES

TGA analyses were performed using a TA Instrument Model Q100 thermogravimetric analyzer. The TGA scans were run from 25–700 C using a 10 C/min ramp rate under flowing air.

EXAMPLES 1–6

Iron (III) catalyzed reaction of a nitro-diol (or triol) with a 2 (or 3) fold excess of isocyanate is allowed to proceed in solution over a period of hours. The nitroisocyanate adduct, a nitro-containing di- (or tri) isocyanate, can be isolated and formulated into PUCB resin systems without sacrificing cure response.

PREPARATION OF NITROISOCYANATES

EXAMPLE 1

Preparation of NMPD/TDI (NMPD/TDI-25)

A 100 mL round bottom flank equipped with a magnetic stirrer was charged with ethyl acetate (50 mL), 2-nitro-2-methyl-1,3-propanediol (NMPD, 6.75 g, 0.05 mol), and tolylene 2,4-diisocyanate (tech grade, 80/20 mixture of 2,4- and 2,6-isomers, 18.2 g, 0.104 mol). After the NMPD crystals had dissolved, iron (III) acetylacetonate catalyst was added as a 0.08 M solution in ethyl acetate (0.0028 g, 0.10 mL solu). The reaction mass warmed from 22 C to 38 C over a period of 30 minutes after which time it began to cool back to room temperature. The reaction was allowed to proceed overnight at room temperature after which time most of the ethyl acetate solvent was removed on a rotary evaporator under vacuum at 50 C. An orange syrupy product (31.4 g) was obtained which theoretically contained 24.3 g solids and 7.1 g residual solvent. To this product was added Sigmacure 7720 Part II Isocyanate Resin (HA International, 72.8 g) and the components thoroughly mixed. The resulting final product was a clear, orange, viscous oil labeled NMPD/TDI-25.

EXAMPLE 2

NMPD/TDI (NMPD/TDI-50)

The procedure as in Example 4 (for NMPD/TDI-25) was repeated, except that the initial product (30.9 g, 24.3 g solids with 6.6 g residual ethyl acetate) was diluted with 24.3 g Sigmacure 7720. The highly viscous, clear solution was diluted with an additional 4 g DBE solvent (Dupont product) to lower the viscosity and facilitate even coating on sand. It was labeled NMPD/TDI-50.

EXAMPLE 3, 4

NMPD/MDI (NMPD/MDI-25 and NMPD/MDI-50)

A 250 mL round bottom flask equipped with a magnetic stirrer was charged with ethyl acetate (7.5 g), 2-nitro-2-methyl-1,3-propanediol (NMPD, 6.75 g, 0.05 mol), and Sigmacure 7720 Part II Isocyanate Resin, i.e. diphenylmethane diisocyanate (MDI)(HA International, 43.7 g) Iron (III) acetylacetonate catalyst was added as a 0.08 M solution in ethyl acetate (0.0028 g, 0.10 mL, solu). The reaction mass remained a slurry as the NMPD crystals were very slow to dissolve. The reaction mass was warmed to 50 C for 8 hours to facilitate the reaction. The reaction was then allowed to proceed overnight at room temperature. The clear, viscous dark brown resin was diluted with an additional aliquot of Sigmacure 7720 Part II (Isocyanate Resin) (33.0 g) and the components thoroughly mixed at 50 C. The resulting final product (91 g) was a clear, orange, viscous oil labeled NMPD/MDI-50. A portion of this mixture (45 g) was removed and diluted with an additional 33.0 g Sigmacure 7720. This product contained approximately half of the original NMPD adduct and was labeled NMPD/MDI-25.

EXAMPLE 5

TN/TDI (TN/TDI-25)

A 100 mL round bottom flask equipped with a magnetic stirrer was charged with ethyl acetate (50 mL), 2-nitro-2-hydroxymethyl-1,3-propanediol (TN, 5.0 g, 0.033 mol), and tolylene 2,4-diisocyanate (tech grade, 80/20 mixture of 2,4- and 2,6-isomers, 18.2 g, 0.104 mol). After the TN crystals had partially dissolved, iron (III) acetylacetonate catalyst was added as a 0.08 M solution in ethyl acetate (0.0028 g, 0.10 mL solu). The reaction mass warmed from 22 C to 35 C over a period of 30 minutes after which time it began to cool back to room temperature. The reaction was allowed to proceed overnight at room temperature after which time most of the ethyl acetate solvent was removed on a rotary evaporator under vacuum at 50 C. An orange syrupy product (30.8 g) was obtained which theoretically contained 23.2 g solids and 7.6 g residual solvent. To this product was added Sigmacure 7720 Part II Isocyanate Resin (HA International, 69.6 g) and the components thoroughly mixed. The resulting final product was a clear, orange, viscous oil labeled TN/TDI-25.

EXAMPLE 6

TN/TDI (TN/TDI-50)

The procedure for TN/TDI-25 was repeated, except that the initial product (30.6 g, 24.3 g solids with 6.3 g residual ethyl acetate) was diluted with 23.2 g Sigmacure 7720. The highly viscous, clear solution was diluted with an additional 3 g DBE solvent (Dupont product) to lower the viscosity and facilitate even coating on sand. It was labeled TN/TDI-50.

EXAMPLE 7

Incorporation of Nitroisocyanates in Foundry Cores—Quantitative Core Response

Partial substitution of the nitroisocyanates for the standard MDI based isocyanate (Sigmacure 7720) in a foundry resin formulation was indeed a substantial improvement over prior art solutions. The formulations, initial and 24 hour tensile data for the nitroisocyanate samples may be seen in the table below.

| Exp. # | Material | Sand/ Amount (g) | Sigmacure 7220 (g) | Nitroisocyanate Additive (g) | Loading on Sand | Initial Tensile Strength (psi) | 24 Hour Tensile Strength (psi) |
|---|---|---|---|---|---|---|---|
| 1 | Control 7720/7220 | 3632 | 25.1 | 20.5* | 1.26% | 238.70 | 259.5 |
| 2 | NMPD/MDI (25) | 3632 | 20.72 | 24.78 | 1.25% | 191.00 | 212.6 |
| 3 | TN/TDI (50) | 3632 | 20.56 | 24.74 | 1.25% | 173.00 | 154.5 |
| 4 | NMPD/TDI (50) | 3632 | 22.88 | 22.62 | 1.25% | 173.70 | 196.8 |
| 5 | NMPD/MDI (50) | 3632 | 20.56 | 24.75 | 1.25% | 139.40 | 175.1 |
| 6 | TN/TDI (25) | 3632 | 22.8 | 22.6 | 1.25% | 189.40 | 217.9 |
| 7 | NMPD/TDI (25) | 3632 | 22.8 | 22.64 | 1.25% | 197.90 | 213.1 |

*Sigmacure 7720.

EXAMPLE 8

Incorporation of Nitroisocyanates—Quantitative Thermal Degradation Testing

Thermal degradation testing of doghouse prepared from the nitroisocyanate systems was performed. The nitroisocyanate foundry resins behaved as desired, losing tensile strength immediately upon heat aging. This may be seen graphically in the Figure where the percent of initial tensile strength lost as a function of heating time is plotted. As is obvious from the plots, the nitroisocyanate additives based on TDI showed substantially increased degrees of degradation at 5 minutes relative to the control. The nitroisocyanate additive based on MDI was much less effective, although it was still an improvement over the control. The degree of degradation at the longer time intervals became much more uniform although the nitro-additives still seemed to have a small positive effect. The loss of differentiation at longer bake times is expected as all polyurethane metrices are unstable at 400 C. It can be inferred from these results that nitroisocyanates are indeed effective in accelerating the degradation of polyurethane matrices in which they are incorporated. Stated in an alternate fashion, the nitroisocyanate additives lower the degradation onset temperature of the polyurethane matrices. Use of the nitro-additives in a PUCB matrix will thus allow the foundry user to either get equivalent degradation over a shorter time at the standard temperature, or get equivalent degradation at the standard time at a lower temperature. The first instance provides the basis for shortening the current TSR bake cycle and improving productivity. The second instance provides the basis for reducing energy costs over the current TSR bake cycle. Both scenarios are desirable.

Figure 2:
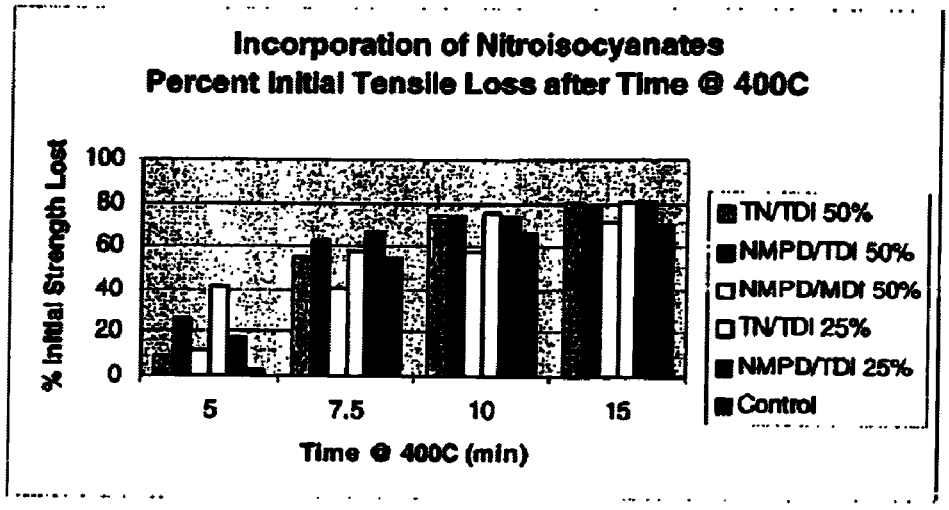
FIG. 2 shows the effect of incorporating nitroisocyanates on the loss of initial tensile strength for several resin compositions.

See FIG. 2 which illustrates the incorporation of nitroisocyanates percent initial tensile loss after time at 400 degrees Centigrade.

EXAMPLE 9

Incorporation of Nitronovolacs

To demonstrate the activity of nitro groups in a phenolic polyol, a nitronovolac was prepared from 2-nitro-2-methyl-1,3-propanediol and phenol. Phenolic condensates with aldehydes and nitroalkanes or nitroalcohols are known in the literature, and all of the variants are herein incorporated by reference. For the purposes of this invention, "phenolic" or "phenol" refers to phenol, substituted phenols, naphthols, substituted naphthols, resorcinols, phloroglucinol, bisphenols (e.g. bisphenol A). Furfural and furfuryl alcohol based aldehyde condensates are also considered to be included in the general description of novolacs.

EXAMPLE 10

Preparation of NMPD/Phenol ($BBNO_2$-33)

Phenol (18.87 g, 0.20 mol), 2-nitro-2-methyl-1,3-propanediol (27.02 g, 0.20 mol) and sodium phenylate trihydrate (0.25 g, 1.5 mmol) were charged into a 3-neck flask equipped with a mechanical stirrer, distillation head with graduated receiver, thermocouple for temperature control, and nitrogen blanket/vacuum port. Under $N_2$, stirring and heating were initiated, brining the internal reaction temperature up to 140 C. After about 10 minutes, a slow distillation of an imniscible mixture of oil/water began. The reaction was held at 140 C for 3 hours during which time a total of 11 mL of distillate was collected (7.8 mL aqueous, 3.2 mL organic oil). Vacuum (80 torr) was then applied to the reaction mass to remove the final traces of oil/water. After 15 minutes under vacuum, an additional 1.9 mL of distillate was collected (1 mL aqueous, 0.9 mL oil) and the distillation had essentially stopped. The reaction was terminated by cooling to room temperature. A dark, glassy solid weighing approximately 29 g was collected. An aliquot of this product (10.0 g) was dissolved in 20 g 1,3-dioxolane solvent. Once complete dissolution was obtained, Sigmacure 7720 Part I Phenolic Resin (60.5 g, HA International) was slowly added with vigorous stirring. The resulting product was a very dark solution free from suspended solids.

EXAMPLE 11

Incorporation of Nitronovolacs—Quantitative Cure Response

The cure response of foundry formulation containing 2 levels of the nitronovolac additive ($BBNO_2$-33) was determined. As seen in the table below, the nitronovolac samples cured to form hard dogbones, which post cured in a manner analogous to the control sample.

| Exp. # | Material | $BBNO_2$ 33 (g) | Sigmacure 7720 (g) | Loading on Sand | Initial Tensile Strength (psi) | 24 Hour Tensile Strength (psi) |
|---|---|---|---|---|---|---|
| 1 | Control 7720/7220 | 25.01 | 20.56 | 1.25% | 238.70 | 259.5 |
| 2 | $BBNO_2$ (33) | 12.56 + 12.60* | 20.41 | 1.25% | 187.20 | 219.2 |
| 3 | $BBNO_2$ (33) | 25.19 | 20.68 | 1.26% | 191.00 | 212.6 |

*This amount of Sigmacure 7220 was used to cut the concentration of $BBNO_2$-33 in half.

EXAMPLE 12

Incorporation of Nitronovolacs—Thermal Degradation Testing by TGA

Figure 3:
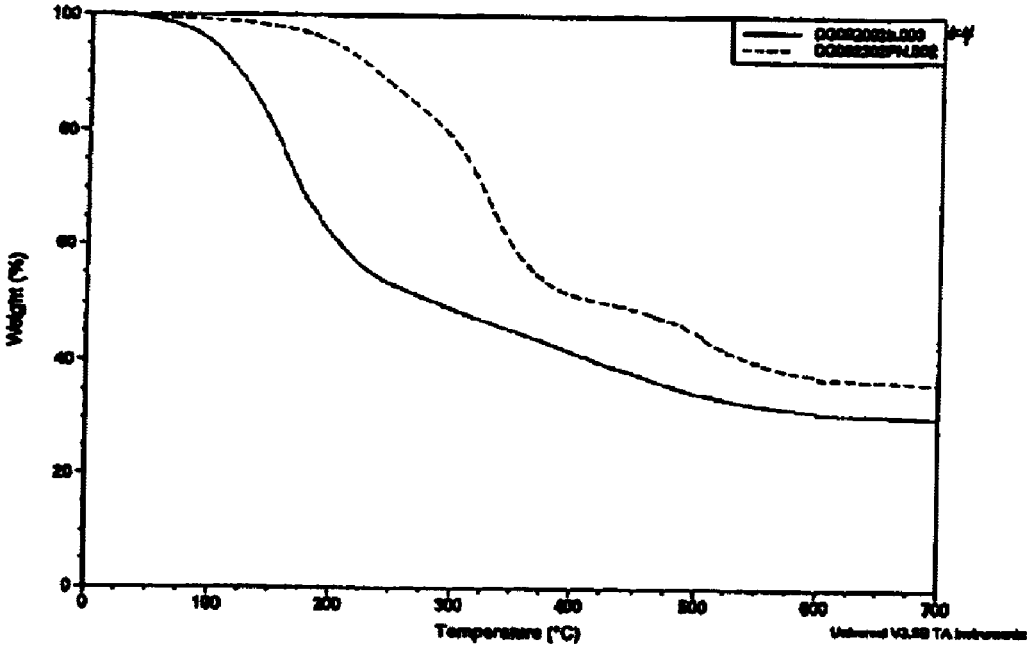
FIG. 3 shows the decline in sample weight as a function of temperature from TGA testing of a nitro-containing novolac and a commercial novolac.

Initial thermal stability testing of the nitronovolac using TGA as a screening tool did indeed demonstrate the lower thermal stability as compared to a standard novolac resin. The overlaid TGA traces of the nitro-containing material and a commercial novolac may be seen in FIG. 3 below. The decomposition onset temperature of the nitronovolac is approximately 100 C lower than the standard novolac.

EXAMPLE 13

Incorporation of Nitronovolacs—Quantitative Thermal Degradation Testing

Figure 4:
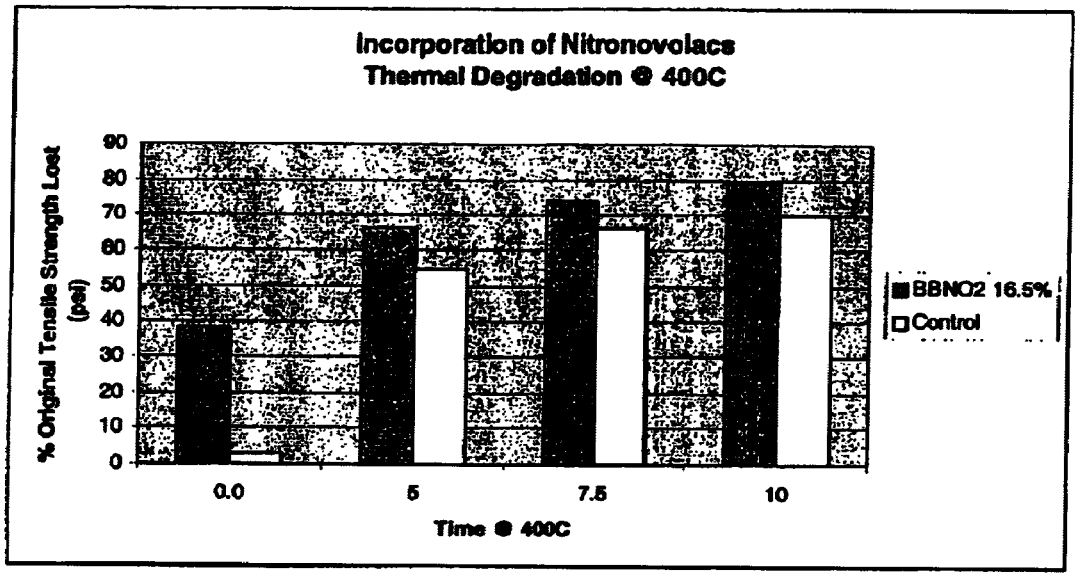
FIG. 4 shows the effect of incorporating nitronovolacs on the loss of tensile strength of resin

Thermal degradation testing of dogbones prepared from the nitronovolac containing resin prepared in Example 13, was performed with positive results. As seen in the graph below, tensile strength degradation began much more rapidly than in the control sample, and, as seen in the nitroisocyanate additives, the degree of degradation at longer time intervals became much more uniform. Again, the loss of differentiation at longer bake times was anticipated for the reasons described above. These results confirm that having the nitro group on either the polyol (Part A) side, or isocyanate (Part B) side of the formulation will result in enhanced thermal degradation. FIG. 4 shows the incorporation of nitronovolacs thermal degradation at 400 degrees Centigrade.

COMPARATIVE EXAMPLE 14

Incorporation of Non-Reactive Nitroalkanes

A resin formulation containing DMDNB (2,3-dimethyl-2,3-dinitrobutane), a compound with 2 thermally labile, tertiary nitro groups was prepared. As can be seen in the table, the DMDNB sample had a cure response essentially identically to the control sample.

| Exp. # | Material | Sand/ Amount | Sigmacure 7220 (g) | Nitroisocyanate Additive (g) | Loading on Sand | Initial Tensile Strength (psi) | 24 Hour Tensile Strength (psi) |
|---|---|---|---|---|---|---|---|
| 4 | DMDNB (4.5 g) | 3632 | 25.02 | 20.59 | 1.26% | 238.7 | 259.5 |
| 5 | Control 7720/ 7220 | 3632 | 25.2 | 20.48 | 1.26% | 231.7 | 256 |

COMPARATIVE EXAMPLE 15

Figure 5:
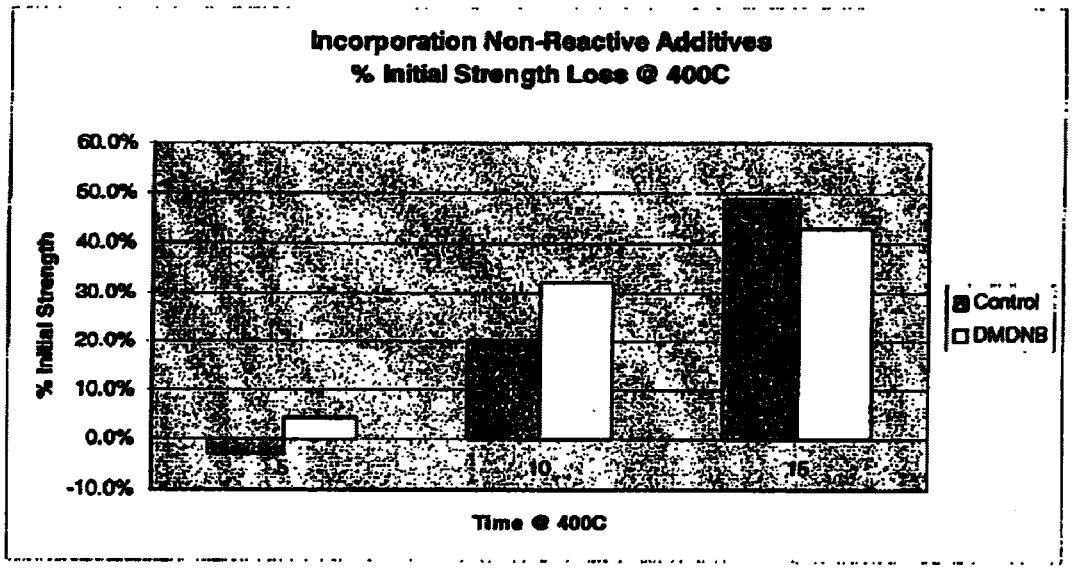
FIG. 5 shows the effect of incorporation of non-reactive additives on the loss of initial strengths of DMDNB, compared to a control.

Incorporation of Non-Reactive Nitroalkanes—Quantitative Thermal Degradation Testing Thermal degradation testing of dogbones prepared form the DMDNB containing resins was performed with marginal results. As can be seen in FIG. 5, the rate of tensile strength loss was minimally enhanced as compared to that of the control sample. As seen in table below, the DMDNB containing sample had the highest concentration of $NO_2$ groups of any sample treated—and the change in degradation rate was minimal. It may thus be concluded that the majority of activity seen with the nitroisocyanate and nitronovolac containing samples is derived from the nitro-containing polyurethane matrix and not merely the presence of non-reactive nitroalkanes.

| Additive | % w/w NA in Part B* | % of Total Formulation |
|---|---|---|
| NMPD/TDI-25 | 6.5% | 3.3% |
| NMPD/TDI-50 | 12.2% | 6.1% |
| NMPD/MDI-25 | 4.3% | 2.4% |
| NMPD/MDI-50 | 6.4% | 3.5% |
| TN/TDI-25 | 5.0% | 2.5% |
| TN/TDI-50 | 8.8% | 4.8% |
| DMDNB | 18% | 9.0% |
| $BBNO_2$-33 | 11% (A) | 5.0% |
| $BBNO_2$-16.5 | 5.5% (A) | 2.5% |

*weight percent of the original nitro compound contained in the Part B formulation (Part A for BBNO2).

While this work has focused on nitronovolacs and nitroisocyanates, other classes of nitro compounds will have equal utility. As would be obvious to one skilled in the art, compounds such as nitro-diamines and higher nitro-polyamines, nitro-polyureas, nitro-containing polyester or polyamide polyols, and others would be useful in these applications.

The key feature of this invention is the presence of a functional group in the polymer backbone that is transformed into a "fashionable site" by thermal treatment. The nitro group has been demonstrated in this work, but other functionality, such as peroxy or perester groups, halogen atoms, and highly strained moieties would also be expected to work.

In a broader sense, this invention could be expected to work in other applications where enhanced thermal degradation of a polymeric system is advantageous. This may include other foundry applications as well as non-foundry applications.

What is claimed is:

1. A foundry resin additive comprising an isocyanate terminated nitroalcohol/isocyanate adduct (nitroisocyanate) having the structure:

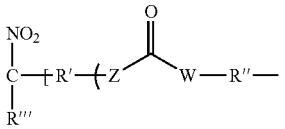

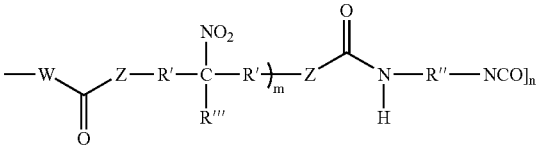

Where:

Z=O, N—H

W=O, C, N—H

R'=—$(CH_2)_x$—,

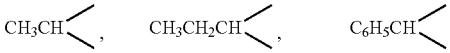

R"=—$(CH_2)_x$—, phenyl, tolyl, isophorone, cyclohexyl, dicyclohexylmethane, diphenylmethane R'''=bond, H, $CH_3$, $CH_3CH_2$ m=0–5 n=2,3 x=1–6.

2. The foundry resin additive of claim 1 wherein Z=O; W=N—H; R'=—$CH_2$—; and R'''=$CH_3$ or $CH_3CH_2$; n=2; and m=0–5.

3. The foundry resin additive of claim 1 wherein Z=O; W=N—H; R'=—$CH_2$—, R'''=bond; n=3; and m=0–5.

4. The foundry resin additive of claim 1 wherein Z=O; W=N—H; and R"=tolyl.

5. The foundry resin additive of claim 1 wherein Z=O; W=N—H; and R"=diphenylmethane.

6. A foundry resin binder composition comprising:

a) a polyol component comprising nitronovolac adducts either alone, or as a mixture with conventional phenolic resins;

b) an isocyanate component;

c) a curing agent.

7. The foundry resin binder composition of claim 6, wherein the polyol component comprises a nitronovolac formed by reacting a nitroalcohol with a phenol.

8. The foundry resin binder composition of claim 6, wherein the polyol component comprises 10–50% of the nitronovolac mixed with 50–90% of a conventional phenolic resin.

9. A foundry resin binder composition of claim 7, wherein the nitroalcohol is selected from the group consisting of 2-nitro-2-methyl-1,3-propanediol, 2-nitro-2-ethyl-1,3-propanediol and 2-nitro-2-hydroxymethyl-1,3-propanediol.

10. The foundry resin binder composition of claim 7, wherein the phenol is selected from the group consisting of phenols, substituted phenols, naphthols, substituted naphthols, polyhydric phenols, resorcinols, phloroglucinol, bisphenols, furfural and furfuryl alcohol.

11. The foundry resin binder composition of claim 6, wherein the polyol component comprises a nitronovolac formed by reacting a nitroalkane with a phenol and formaldehyde.

12. The foundry resin binder composition of claim 11, wherein the nitroalkane is selected from the group consisting of nitromethane, nitroethane and 1-nitropropane.

13. The foundry resin binder composition of claim 11, wherein the phenol is selected from the group consisting of phenols, substituted phenols, naphthols, substituted naphthols, polyhydric phenols, resorcinols, phloroglucinol, bisphenols, furfural and furfuryl alcohol.

14. A foundry resin binder composition comprising:

a) a polyol component;

b) an isocyanate component comprising of nitroisocyanate adducts, either alone, or as a mixture with conventional polyisocyanates;

c) a curing agent.

15. The foundry resin binder composition of claim 14, wherein the isocyanato urethane polymer comprises a nitroisocyanate adduct formed by reacting a nitroalcohol with a polyisocyanate.

16. The foundry resin binder composition of claim 14, wherein the isocyanate component comprises 10–50% of the nitroisocyanate mixed with 50–90% of a conventional polyisocyanate.

17. The foundry resin binder composition of claim 15, wherein the nitroalcohol is selected from the group consisting of 2-nitro-2-methyl-1,3-propanediol, 2-nitro-2-ethyl-1,3-propanediol and 2-nitro-2-hydroxymethyl-1,3-propanediol.

18. The foundry resin binder composition of claim 15, wherein the polyisocyanate is selected from the group consisting of tolylene 2,4-diisocyanate, isophorone diisocyanate and diphenylmethane diisocyanate.

19. The foundry resin binder composition of claim 14, wherein the curing agent comprises a urethane catalyst.

20. A process of forming shaped foundry articles for use in casting lightweight metals, which articles collapse after casting of said lightweight metals thereby reducing or eliminating energy and/or time required for shake-out, comprising:

a) forming a foundry mix by distributing on an aggregate a binding amount of 0.2%–10%, based upon the weight of the aggregate, of a binder composition, said composition comprising in admixture a polyol component and an isocyanate component, said isocyanate component comprising a mixture of nitroisocyanate urethane polymers with isocyanato urethane polymers wherein all hydroxy groups of said polymers are capped;

b) shaping the foundry mix into the desired foundry article; and c) allowing the article to cure in the presence of a catalyst.

21. The process of claim 20 wherein the isocyanato urethane polymer comprises a nitroisocyanate adduct formed by reacting a nitroalcohol with a polyisocyanate wherein the molar equivalent of NCO groups of said polyisocyanate exceeds the molar equivalent of OH groups of said nitroalcohol.

22. The process of claim 21 wherein the polyisocyanate component comprises tolylene diisocyanate.

23. The process of claim 21 wherein the polyisocyanate component comprises diphenylmethane diisocyanate.

24. The process of claim 21 wherein the nitroalcohol component comprises 2-nitro-2-methyl-1,3-propanediol.

25. The process of claim 21 wherein the nitroalcohol component comprises 2-nitro-2-ethyl-1,3-propanediol.

26. The process of claim 21 wherein the nitroalcohol component comprises 2-nitro-2-hydroxymethyl-1,3-propanediol.

27. A process of forming shaped foundry articles for use in casting lightweight metals, which articles collapse after casting of said lightweight metals thereby reducing or eliminating energy and/or time required for shake-out, comprising:

a) forming a foundry mix by distributing on an aggregate a binding amount of 0.2%–10%, based upon the weight of the aggregate, of a binder composition, said composition comprising in admixture a polyol component and an isocyanate component, said polyol component comprising a mixture of nitronovolac polymers formed by reacting a nitroalkane with a phenol and formaldehyde;

b) shaping the foundry mix into the desired foundry article; and c) allowing the article to cure in the presence of a catalyst.

28. The process of claim 27 wherein the polyol comprises a nitronovolac formed by reacting a nitroalkane with formaldehyde and phenol.

29. The process of claim 28 wherein the nitroalkane component comprises nitromethane.

30. The process of claim 28 wherein the nitroalkane component comprises nitroethane.

31. The process of claim 28 wherein the nitroalkane component comprises 1-nitropropane.

32. A process of forming shaped foundry articles for use in casting lightweight metals, which articles collapse after casting of said lightweight metals thereby reducing or eliminating energy and/or time required for shake-out, comprising:

a) forming a foundry mix by distributing on an aggregate a binding amount of 0.2%–10%, based upon the weight of the aggregate, of a binder composition, said composition comprising in admixture a polyol component and an isocyanate component, said polyol component comprising a mixture of nitronovolac polymers formed by reacting a nitroalcohol with a phenol;

b) shaping the foundry mix into the desired foundry article; and c) allowing the article to cure in the presence of a catalyst.

33. The process of claim 32 wherein the polyol comprises a nitronovolac formed by reacting a nitroalcohol with phenol in the presence of a catalyst.

34. The process of claim 33 wherein the nitroalcohol component comprises 2-nitro-2-methyl-1,3-propanediol.

35. The process of claim 33 wherein the nitroalcohol component comprises 2-nitro-2-ethyl-1,3-propanediol.

36. The process of claim 33 wherein the nitroalcohol component comprises 2-nitro-2-hydroxymethyl-1,3-propanediol.

37. The process of claim 20 wherein the curing agent is a urethane catalyst.

38. The process of claim 27 wherein the curing agent is a urethane catalyst.

39. The process of claim 32 wherein the curing agent is a urethane catalyst.

* * * * *